United States Patent [19]

Elson

[11] Patent Number: 4,488,374

[45] Date of Patent: Dec. 18, 1984

[54] ARTICLE DROPPING BALLOON

[76] Inventor: Lloyd C. Elson, 156 Columbia Dr., Huron Park, Ontario, Canada, N0M 1Y0

[21] Appl. No.: 546,756

[22] Filed: Oct. 28, 1983

[51] Int. Cl.[3] ..... A63H 3/06

[52] U.S. Cl. ..... 446/220

[58] Field of Search ..... 46/87, 88, 89, 86 R, 46/1 H, 74 R; 244/155 R

[56] References Cited

U.S. PATENT DOCUMENTS

| | | | |
|---|---|---|---|
| 2,701,935 | 2/1955 | Florence | 46/86 R |
| 4,408,412 | 10/1983 | Forker | 46/89 |
| 4,424,643 | 1/1984 | Tilghman | 46/86 R |

*Primary Examiner*—Mickey Yu

*Attorney, Agent, or Firm*—Hirons, Rogers & Scott

[57] ABSTRACT

A new article dropping tow consists of a suitably buoyant body or the like, such as a gas-filled balloon, carrying one or more releasable articles, such as a glider, a toy parachutist or a bomb, retained on the buoyant body by, for example a hook on one engaged in an opening in the other, arranged to release automatically when the upwardly-moving body suddenly changes its vertical movement, e.g. by bumping against an overhead surface, such as the ceiling of a room in which the toy is released, or by reaching the end of its tether string, or by the operator jerking on the string. The release is then effected by the movement of the body which disengages the article and allows it to drop. The body can be a balloon of spherical shape that is tilted to one side by the weight of the article and the attachment hook, so that the balloon ascends in this tilted attitude and rolls and bumps upon hitting the overhead surface, or rolls when the tether string tightens, the change in attitude facilitating the release of the article. The body can instead be a balloon of oval shape that is held by the weight of the article and the attachment hook to an upwardly-inclined attitude during ascent, so that it also rolls and bumps upon hitting the ceiling. A number of different release systems are provided other than the hook and aperture.

10 Claims, 6 Drawing Figures

FIG. 5
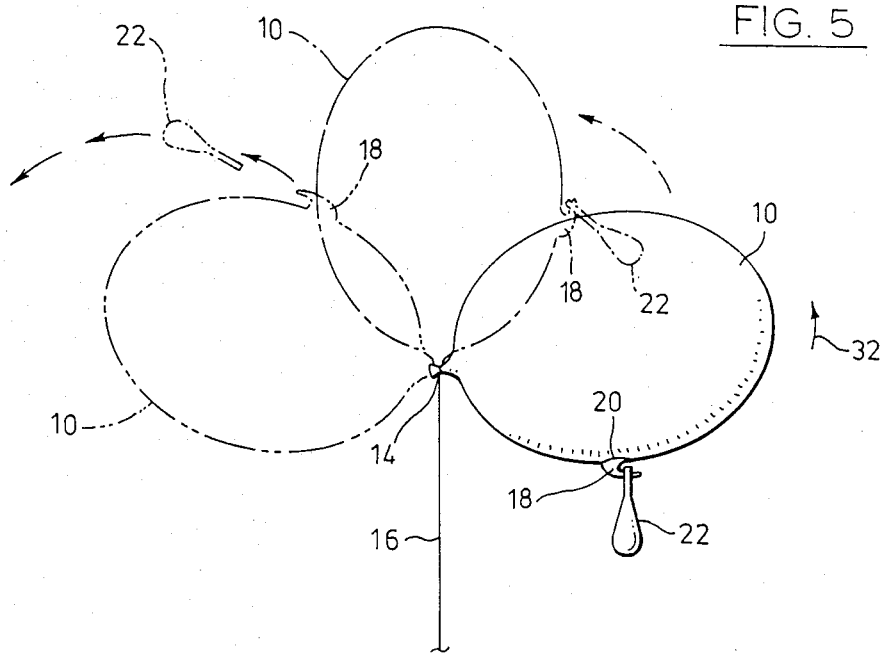
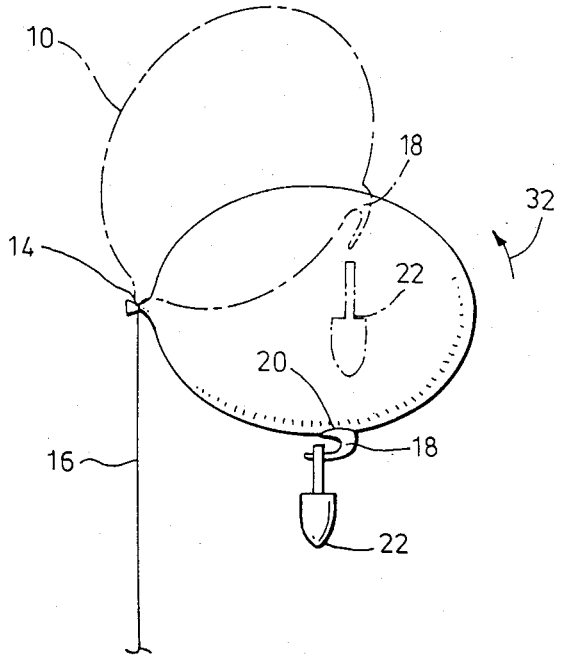
FIG. 6

ARTICLE DROPPING BALLOON

FIELD OF THE INVENTION

This invention is concerned with improvements in or relating to article dropping balloons.

DESCRIPTION OF THE PRIOR ART

There is described in my prior U.S. Pat. No. 4,183,481 an article dropping kite with which the article to be dropped is held to the body of the kite during flight by a removable closure means that is removed by tugging on the kite string, the tug causing a change in length of the kite string which results in a pull on a string controlling the closure means. There is described in my subsequent prior U.S. Pat. No. 4,369,939 an article dropping kite or the like in which holding means frictionally releasably hold the article on the kite body and permit release only upward against gravity and at least approximately aligned with the longitudinal flight direction of the attached kite string. The desired release is obtained by causing a jerk along the tethering string, whereupon the frictional retention is overcome by the inertia of the device, which upon such release falls to earth under gravity. It is mentioned therein that an alternative method of release is to pull the kite gently downwards and then allow it under the influence of wind to regain its former position relative to the operator with a jerk; in this case the upward movement of the kite is suddenly stopped leaving the releasable units with sufficient impetus upward to overcome the friction and be released therefrom. Both of my prior patents contain listings of prior art disclosures pertinent to the respective inventions, but none are believed to anticipate the present invention.

DEFINITION OF THE INVENTION

It is the object of the present invention to provide a new article dropping toy that is particularly simple and effective to operate.

It is a more specific object to provide a new article dropping toy that is particularly suited for indoor use and by young children.

It is a particular object to provide a new article dropping balloon toy, employing a buoyant body to carry aloft the article that is to be dropped.

In accordance with the present invention there is provided an article dropping balloon comprising:

a buoyant body of oval shape in a vertical plane and of buoyancy such that it can move upwards by its buoyancy in air carrying an article to be dropped therefrom;

at least one releasable article adapted for releasable attachment to the buoyant body during the upwards movement of the body for upward carriage of the article until the upwardly moving buoyant body encounters an overhead surface against which it bumps;

releasable attachment means on the buoyant body for releasably attaching the releasable article to the body when the body is in an article retaining attitude; and a tether string attached to the buoyant body at a location thereon displaced from the releasable attachment means;

the releasable attachment means releasing the releasable article therefrom upon a sudden change in vertical movement of the buoyant body caused by its engagement with the said overhead surface, the release of the article being facilitated by a change of the buoyant body from an article retaining attitude to an article releasing attitude resulting from the buoyant body encountering the said overhead surface.

Also in accordance with the invention there is provided an article dropping toy comprising:

a buoyant body of buoyancy such that it can move upwards by its buoyancy in air carrying an article to be dropped therefrom;

at least one releasable article adapted for releasable attachment to the buoyant body during the upwards movement of the body for upward carriage of the article;

releasable attachment means on the buoyant body for releasably attaching the releasable article to the body when the body is in an article retaining attitude;

the location of the said releasable attachment means on the body being such that the buoyant body is urged during its ascent to an article retaining attitude by the weight of the releasable article;

a tether string attached to the buoyant body at a location thereon displaced from the releasable attachment means; and the releasable attachment means releasing the releasable article therefrom upon a sudden change in vertical movement of the buoyant body upon the buoyant body bumping against an overhead surface, the buoyant body rotating by its momentum to an article releasing attitude upon bumping against the said overhead surface.

DESCRIPTION OF THE DRAWINGS

Article dropping toys which are particular preferred embodiments of the invention will now be described, by way of example, with reference to the accompanying diagrammatic drawings, wherein:

FIGS. 4 through 6 are respective side elevations similar to FIG. 1 of respectively fourth, fifth and sixth embodiments.

DESCRIPTION OF THE PREFERRED EMBODIMENTS

Figure 1:
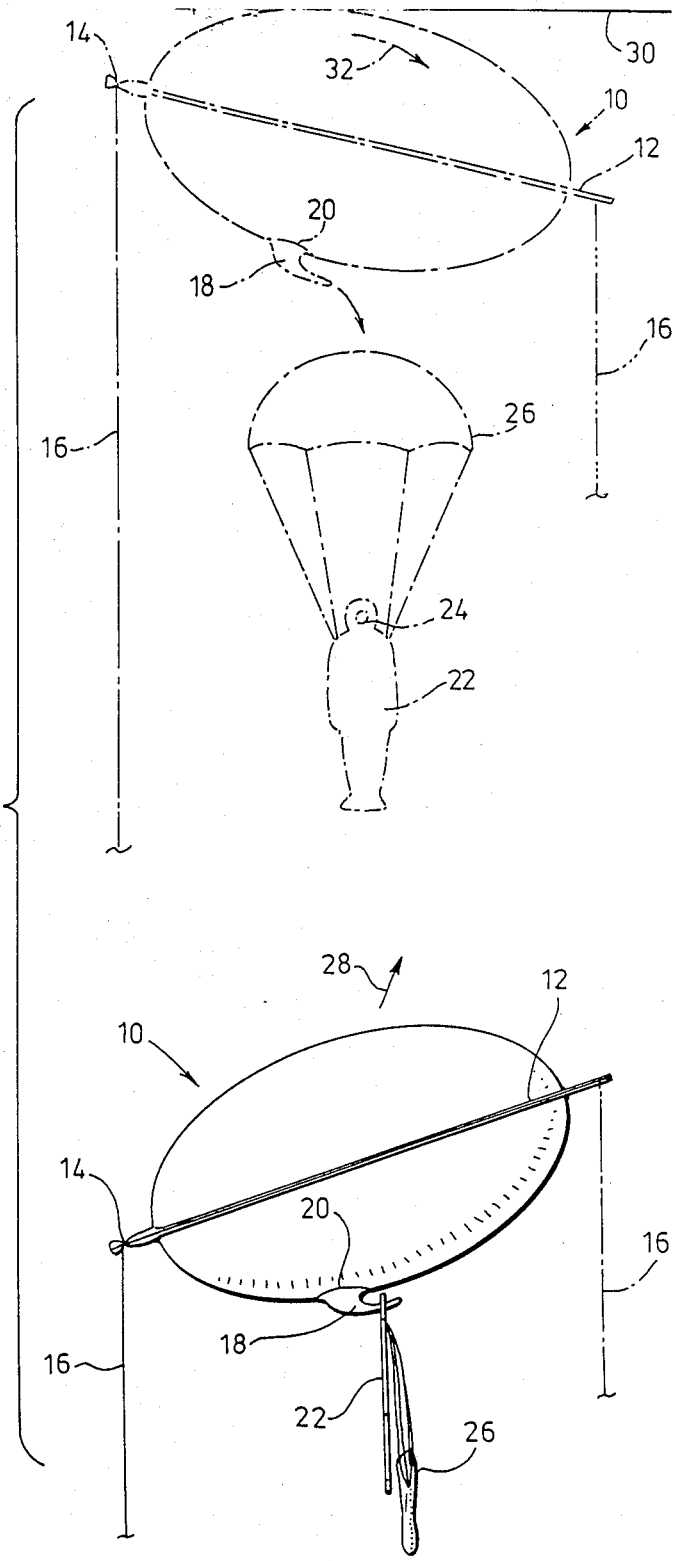
FIG. 1 is a side elevation of a first embodiment, showing in solid lines the toy in its ascent/article retaining attitude and in broken lines the same toy in stopped/article releasing attitude.

Referring now to FIG. 1, a first embodiment comprises a balloon of the kind made by sealing together at their registering edges two thin sheets of a suitable gas-impervious material, such as that sold under the trade mark "Mylar", so that the balloon even when fully inflated is of flattened ovoid, or elliptical cross-section in the vertical plane. The balloon is indicated generally by the reference 10, while the sealed-together edges are indicated by reference 12 and these edges in effect define what may be regarded as a horizontal major plane containing the major axis of the said ellipse. The usual filling neck 14 is provided at one point on the circumference of the balloon as a break in the sealing together of the two edges and also serves as the point of attachment for a tether or control string 16.

In this embodiment the holding means for the device to be dropped by the toy consists of a hook member 18 fastened to or integral with a flat base member 20 that is in turn fastened, e.g. by glueing, to one of the sheets. Because of the weight of the holding means and the article to be dropped this sheet becomes the underside of the balloon, the hook lying in a vertical plane with its open side facing "forward" away from the neck 14 and the tether string 16. The releasable device to be dropped is for this particular embodiment illustrated as a flat member 22 having therein an opening 24 by which it can be hooked onto the hook member 18, and on which it will remain as long as the balloon is in the ascending article retaining attitude shown in solid lines in FIG. 1, to which it has been moved by the weight of the article, in which the hook "opens" at least slightly upwards. The releasable device can be of the shape and/or be printed, or otherwise decorated, to have the appearance of a person (e.g. a paratrooper) and is then provided with a small automatically operable parachute 26. Alternatively the device can be decorated and/or configured in some way to represent a freely droppable object, e.g. a bomb, when a parachute will not be appropriate.

The balloon is filled with any gas that is lighter than air, so that it is buoyant and will ascend against gravity in the upward and forward direction indicated by the arrow 28. Since the toy is predominantly for use by children, the gas should be non-inflammable helium, and the size of the balloon is made sufficiently large to give the required lifting capacity and capability of achieving a sufficient upward velocity when released in the confines of an average room. The hook member 18 is placed to one side of the centre of buoyancy, toward the filling nozzle 14, so that inherently as the balloon ascends it will be urged by the weight of the attachment member 18, and also by the weight of the attached device 22 to have the hook pointing upwards, as illustrated in solid lines, so that the device 22 is positively retained on the hook.

This upward article retaining inclination is in this embodiment even more positively assured by the weight of the string 16. This particular embodiment normally is allowed to float freely upward with the operator holding the end of the string, in any location at which there is available a ceiling 30, or its equivalent, to arrest its upward movement relatively suddenly. As the balloon bumps against the ceiling its upward momentum causes it to bump downwards. Since the releasable article is hanging relatively freely on the attachment means its upward momentum will cause it to continue to move upwards, so that the combination of upward momentum and downward recoil cooperate in causing the separation of the article from the releasing means, whereupon the article will drop. If for some reason this action is not sufficient for releasing to take place, the balloon will also rotate in the vertical plane of the hook device, as indicated by the arrow 32, at least to the horizontal, and more likely to the downwardly inclined releasing attitude shown in broken lines, in which the hook device 18 opens at least horizontally, and more likely slightly downward, so that the dropping device will be dumped therefrom. The device 22 will then fall freely, or if provided with a parachute then the parachute will open and the device will float down to the floor. The string 16 is made long enough that a child operator can reach its lower end and retrieve the balloon from the ceiling, and can also jerk upon the string for release, if for some reason release has not already been achieved.

In an alternative embodiment the string 16 is attached to the other side of the releasing means, as shown in chain broken lines. In such an embodiment the change of vertical movement of the balloon can be obtained by a jerk on the tether string while the string is tight, because the balloon has reached its end, or while the balloon is against the ceiling and the string is first tightened by the operator.

Figure 2:
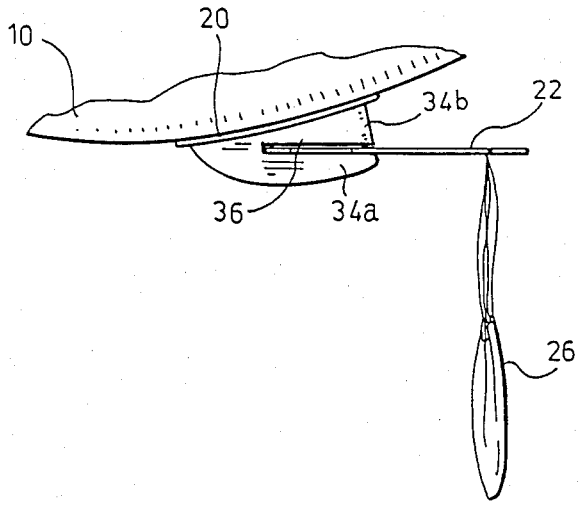
FIG. 2 is a side elevation of part only of a second embodiment, showing the holding means thereof.

FIG. 2 illustrates another form that can be taken by the holding/releasing means consisting of two opposed members **34*a* and 34*b* forming between themselves a forwardly-opening horizontal slot 36 into which the member 22** can be inserted and retained until the balloon bumps and rotates against the ceiling for release of the article.

Figure 3:
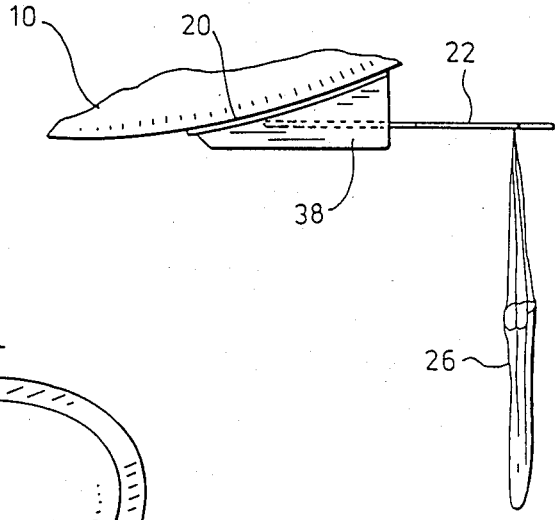
FIG. 3 is a partial side elevation similar to FIG. 3 of a third embodiment.

FIG. 3 illustrates still another form taken by the retaining/releasing means consisting of a pocket-forming member 38 mounted on the base 20 and forming a forwardly opening pocket into which the device is inserted.

Figure 4:
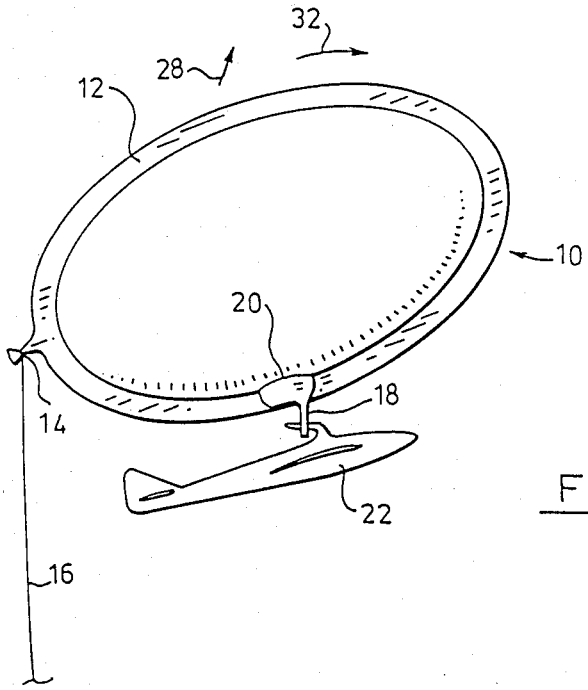

FIG. 4 illustrates a fourth embodiment in which the releasing means 18 are fastened at the seam 12 between the two sheets forming the balloon, so that this seam lies in the vertical plane. In this embodiment it is the article 22 that is provided with a hook that engages in a loop 18 carried by the base 20. The operation of the embodiment in releasing the article 22 is the same, and in this embodiment it takes the form of a light-weight glider that upon release will glide to the floor.

FIG. 5 illustrates a fifth embodiment of the invention employing a balloon 10 of the usual nearly spherical shape. The article retaining means 18, 20 are fastened to one side of the balloon body and their weight thus tilt the body of the balloon to a corresponding ascending attitude shown in solid lines, the device automatically moving to the lowest position because of its weight. The hook 18, or the equivalent releasable means 36 (FIG. 2) or 38 (FIG. 3), retains the device 22 until the balloon is stopped suddenly in its upward vertical movement upon reaching the end of the tether string, so that it tightens in the operator's hand, the resulting rebound of the balloon against the string combined with the continued upward momentum of the device releasing the device from the hook 18. The upward momentum of the balloon will again also produce releasing rotation in the direction of the arrow 32, the balloon moving rapidly from the attitude shown in solid lines, through the attitude shown in broken lines to the releasing attitude shown in chain broken lines. It is found that with a sufficiently light device 22, the momentum is such that the device is thrown over the top of the balloon well clear of the balloon and the tether string, as indicated by the chain arrow 32 in FIG. 6. The hook device 18 can surprisingly therefore point somewhat upwards as the balloon moves to its releasing attitude, in the direction opposite to that which one would normally expect, so that positive retention is obtained.

FIG. 6 illustrates a sixth embodiment intended for a slightly heavier releasable device and in which the hook device points slightly upward in the retaining attitude shown in solid lines as the result of its weight on the hook, but points downward for release of the article as shown in broken lines if it has not been jolted free by the original arrest of the vertical upward movement.

Although only balloons of spherical and oval shape are illustrated, it will be understood that the invention is applicable to any form of balloon. For example, it could be in the elongated shape of a dirigible or zeppelin, or even in some special shape of a normally non-buoyant device such as an airplane. The fabric of such a body can be imprinted with a suitable picture to make it more realistic.

I claim:

1. An article dropping balloon comprising:

a buoyant body of oval shape in a vertical plane and of buoyancy such that it can move upwards by its buoyancy in air carrying an article to be dropped therefrom;

at least one releasable article adapted for releasable attachment to the buoyant body during the upwards movement of the body for upward carriage of the article until the upwardly moving buoyant body encounters an overhead surface against which it bumps;

releasable attachment means on the buoyant body for releasably attaching the releasable article to the body when the body is in an article retaining attitude; and a tether string attached to the buoyant body at a location thereon displaced from the releasable attachment means;

the releasable attachment means releasing the releasable article therefrom upon a sudden change in vertical movement of the buoyant body caused by its engagement with the said overhead surface, the release of the article being facilitated by a change of the buoyant body from an article retaining attitude to an article releasing attitude resulting from the buoyant body encountering the said overhead surface.

2. An article dropping toy as claimed in claim 1, wherein the releasable attachment means comprise a hook member of the buoyant body engaged in an aperture in the releasable article.

3. An article dropping toy is claimed in claim 1, wherein the releasable attachment means comprise a hook member of the releasable article engaged in an aperture of the buoyant body.

4. An article dropping toy as claimed in claim 1, wherein the releasable attachment means comprise a pair of opposed members attached to the buoyant body and forming between themselves a slot in which the releasable article is engaged and from which the releasable article is released upon said change of attitude of the buoyant body.

5. An article dropping toy as claimed in claim 1, wherein the releasable attachment means comprise a pocket attached to the buoyant body in which the releasable article is engaged and from which the releasable article is released upon said change of attitude of the buoyant body.

6. An article dropping toy as claimed in claim 1, wherein the buoyant body is urged during its ascent to the article retaining attitude by the weight of the releasable article.

7. An article dropping toy as claimed in claim 6, wherein the buoyant body is also urged to the article retaining attitude by the weight of the part of the releasable attachment means attached to the buoyant body.

8. An article dropping toy comprising:

a buoyant body of buoyancy such that it can move upwards by its buoyancy in air carrying an article to be dropped therefrom;

at least one releasable article adapted for releasable attachment to the buoyant body during the upwards movement of the body for upward carriage of the article;

releasable attachment means on the buoyant body for releasably attaching the releasable article to the body when the body is in an article retaining attitude;

the location of the said releasable attachment means on the body being such that the buoyant body is urged during its ascent to an article retaining attitude by the weight of the releasable article;

a tether string attached to the buoyant body at a location thereon displaced from the releasable attachment means; and the releasable attachment means releasing the releasable article therefrom upon a sudden change in vertical movement of the buoyant body upon the buoyant body bumping against an overhead surface, the buoyant body rotating by its momentum to an article releasing attitude upon bumping against the said overhead surface.

9. An article dropping toy as claimed in claim 8, wherein the buoyant body is also urged to an upwardly inclined ascending attitude by the weight of the tether string.

10. An article dropping toy as claimed in claim 8, wherein the buoyant body is also urged to the article retaining attitude by the weight of the part of the releasable attachment means attached to the buoyant body.

* * * * *